US007365620B2

(12) United States Patent
Taylor

(10) Patent No.: US 7,365,620 B2
(45) Date of Patent: Apr. 29, 2008

(54) MICROWAVE WINDOW WITH A TWO PART METALLIC FRAME HAVING DIFFERENT COEFFICIENTS OF THERMAL EXPANSION

(75) Inventor: Edward Allen Taylor, 905 Rosalind Pl., West Melbourne, FL (US) 32904

(73) Assignees: SRI Hermetics, Inc., Melbourne, FL (US); Edward Allen Taylor, Melbourne, FL (US)

( * ) Notice: Subject to any disclaimer, the term of this patent is extended or adjusted under 35 U.S.C. 154(b) by 0 days.

(21) Appl. No.: 11/491,811

(22) Filed: Jul. 24, 2006

(65) Prior Publication Data

US 2006/0284709 A1 Dec. 21, 2006

Related U.S. Application Data

(62) Division of application No. 11/074,256, filed on Mar. 7, 2005.

(51) Int. Cl.
*H01P 1/08* (2006.01)

(52) U.S. Cl. ..... 333/252

(58) Field of Classification Search ..... 333/252
See application file for complete search history.

(56) References Cited

U.S. PATENT DOCUMENTS

| | | | | |
|---|---|---|---|---|
| 2,881,401 | A * | 4/1959 | Bondley | 333/252 |
| 3,382,466 | A * | 5/1968 | Kahl et al. | 333/252 |
| 3,675,165 | A * | 7/1972 | Ueda et al. | 333/252 |
| 4,352,951 | A | 10/1982 | Kyle | 174/152 GM |
| 4,690,480 | A | 9/1987 | Snow et al. | 439/364 |
| 4,960,391 | A | 10/1990 | Beinhaur et al. | 439/559 |
| 5,041,019 | A | 8/1991 | Sharp et al. | 439/559 |
| 5,109,594 | A | 5/1992 | Sharp et al. | 29/600 |
| 5,110,307 | A | 5/1992 | Rapoza | 439/566 |
| 5,298,683 | A | 3/1994 | Taylor | 174/152 |
| 5,563,562 | A | 10/1996 | Szwec | 333/260 |
| 5,936,494 | A | 8/1999 | Pollock | 333/252 |
| 5,986,208 | A | 11/1999 | Taylor et al. | 174/50.58 |
| 6,841,731 | B1 | 1/2005 | Zanello | 174/50.56 |
| 6,899,545 | B2 | 5/2005 | Pollock et al. | 439/63 |
| 6,932,644 | B1 | 8/2005 | Taylor | 439/566 |

* cited by examiner

*Primary Examiner*—Benny Lee
(74) *Attorney, Agent, or Firm*—Allen, Dyer, Doppelt, Milbrath & Gilchrist, P.A.

(57) ABSTRACT

An RF feed-through connector has a single pin or multi-pins supported and hermetically sealed between a first portion of the connector facing the hermetically sealed interior portion of an electronics-containing housing and a second portion of the connector exposed to ambient conditions in which the electronics-containing housing is placed. The invention is particularly directed to a new hermetically sealed RF feed-through connector architecture in which the connector's outer shell contains a relatively low coefficient of thermal expansion (CTE) portion that enables it to be soldered to a low CTE insert that supports one or more hermetically sealed longitudinal signal pins. The connector's outer shell also includes a relatively high CTE portion that allows the shell to be readily joined as by welding to an adjacent support structure, such as a relatively high CTE aluminum housing and the like.

3 Claims, 12 Drawing Sheets

MICROWAVE WINDOW WITH A TWO PART METALLIC FRAME HAVING DIFFERENT COEFFICIENTS OF THERMAL EXPANSION

CROSS-REFERENCE TO RELATED APPLICATION

The present application is a divisional application of U.S. patent application Ser. No. 11/074,256, filed on Mar. 7, 2005, now U.S. Pat. No. 7,144,274, issued Dec. 5, 2006, entitled "Hermetically Sealed, Weldable Connectors", assigned to the assignees of the present application, and the disclosure of which is incorporated herein.

FIELD OF THE INVENTION

The present invention relates in general to single pin type feed-throughs, multi-pin headers, or multi-pin connectors in which one or more conductors or pins are supported and hermetically sealed between a first portion of the connector facing the hermetically sealed interior portion of an electronics-containing housing and a second portion of the connector exposed to ambient conditions in which the electronics-containing housing is placed. The invention is particularly directed to a new and improved hermetically sealed coaxial type RF feed-through architecture in which the connector's outer shell contains a relatively low coefficient of thermal expansion (CTE) portion that enables it to be soldered to a low CTE ferrule or insert that supports one or more hermetically sealed longitudinal signal pins. The connector's outer shell also includes a relatively high CTE portion that allows the shell to be readily joined as by welding to an adjacent support structure, such as a relatively high CTE aluminum housing and the like. Pursuant to a further aspect of the invention, the architecture detailed herein may also be employed to hermetically seal microwave window structures or assemblies.

BACKGROUND OF THE INVENTION

The architecture of a conventional hermetically sealed coaxial type feed-through RF connector is diagrammatically illustrated in cross-section in FIG. 1 as comprising a longitudinal pin or center signal conductor 10 of conductive material, such as KOVAR (KOVAR is a federally registered trademark of Carpenter Technology Corporation and will hereinafter be denoted as KOVAR (Reg. Tdmk)), that lies along the axis 12 of the RF connector. Pin 10, as well as the remaining components of the RF connector, are cylindrically symmetrical about axis 12. A first portion 11 of pin 10 is shown as being surrounded and hermetically sealed by a dielectric material, such as a generally cylindrical glass member 20, from one end of which projects an interior distal end 13 of the pin 10. A second portion 14 of the pin passes through a bore 31 in a Teflon bushing 30 and terminates at an exterior distal end 15. The glass member 20 adjoins and is hermetically sealed against a generally cylindrical KOVAR (Reg. Tdmk) ferrule 40 having a generally 'L' shaped cross-section, that facilitates welding of the ferrule to a compatible metallic ring portion of an adjoining outer shell 50. Ferrule 40 includes an annular depression 41, which is typically referred to in the industry as a stress-relief cut, or thermal isolation groove. The outer diameter of a base portion 42 of the ferrule 40 is sized to fit within and be captured by a generally cylindrical slot or depression 51 within a first end portion 52 of outer shell 50.

The outer shell 50 is typically made of duplex material, in particular two dissimilar metals, and includes a first or main body portion 53 of a first metal such as aluminum to facilitate welding the shell to the next high layer of the assembly, such as to an adjacent (aluminum) support housing 60, and a second body portion 54 which adjoins the base portion 42 of the ferrule and is made of a material that is metallurgically compatible with the material of the ferrule—in this case KOVAR (Reg. Tdmk), for example, so as to facilitate laser welding of the shell to the ferrule and thereby providing the intended hermetic seal therebetween. The first (aluminum) and second (KOVAR (Reg. Tdmk)) body portions of the shell 50 are typically joined together by explosion welding.

Region 70 represents a portion of a laser weld used to metallurgically join the base portion 42 of the KOVAR (Reg. Tdmk), ferrule with the second body portion 54 of the outer shell 50. It is to be understood that the laser weld 70 forms an annular weld joint completely around the adjoining portions of the KOVAR (Reg. Tdmk), ferrule 40 and the KOVAR (Reg. Tdmk), portion of shell 50. A depiction of the material of the weld 70 has been omitted from the lower portion of FIG. 1 in order to show the pre-weld shapes of the components.

An electrically conductive contact spring 80 is captured along the outer reduced diameter portion 45 of the KOVAR (Reg. Tdmk) ferrule 40 and serves as a portion of the conductive path for the cylindrical ground plane that surrounds the center pin 10. In addition, an electrically conductive flexible gasket 90, such as a rubber gasket impregnated with metallic (e.g., silver) particles, is retained within an annular depression 56 within the shell 50 so as to maintain intimate contact with the shell and the glass-sealed feed-through, and like spring 80, serves as a portion of the conductive path for the ground plane. The electrically conductive gasket is necessary since the only positive contact between the shell 50 and the glass-sealed feed-through is the laser weld 70, which must be located away from the glass to prevent heat damage of the glass during welding. It may also be noted that those portions of the RF connector where signal travels are coated with a highly conductive metal such as gold. This includes the outer surface of center pin 10 and the interior wall surface of shell 50 and ferrule 40.

Now although the purpose of the RF connector architecture of FIG. 1 is to provide a low expansion feed that passes through a high electrical performance material (glass), into a high expansion package, it suffers from its large size, a mismatch of the electrical path lengths along the relatively long and undulating ground path and the relatively straight center conductor, which the ground plane surrounds, formation of the laser weld is labor intensive and the laser weld region itself is subject to corrosion. The large size is due to the fact that the diameter of the feed-through must be increased to accommodate the thermal isolation groove to prevent damage to the glass seal due to heat during welding. The increase in ground path length is due to the combination of materials employed in order to ensure a continuous ground path through the entirety of the RF connector.

This signal and ground plane length mismatch may be understood by reference to FIG. 2, which shows a bold straight arrow 200, which represents the signal path that is established along the plated outer surface of center pin 10, and by way of the bold undulating arrow 210 which traverses the interior plated regions of shell 50 and ferrule 40, as well as the electrically conductive gasket 90 and the contact spring 80 (the purpose of which is to ensure that the ground path is continuous). In order for the coaxial feed-through to electrically function properly, the ground path should be as straight and short as possible so as to match the distance traversed by the signal along the center pin. It may be noted that if the electrically conductive gasket 90 were omitted from the RF connector architecture of FIGS. 1 and 2, the resulting structure, shown in FIG. 3, would cause the ground path length to increase very substantially, producing an "out of phase" RF signal which could severely degrade or null the RF transmission.

The susceptibility of the laser weld to corrosion is due to the fact that the there is no hermetic seal between the center pin and the Teflon bushing, so that ambient moisture is able to leak along the exterior joints of the RF connector and reach the laser weld 70 between the iron-containing material of the base portion 42 of the KOVAR (Reg. Tdmk) ferrule 40 and the iron-containing material of the second body portion 54 of the shell. Moreover, formation of the laser weld is labor intensive, since the region where the weld is to be made must be masked prior to plating the surfaces of the ferrule and the outer shell. The weld masking material must then be removed in order to perform the welding operation on the bare (KOVAR (Reg. Tdmk)) metal of the outer shell and the ferrule.

SUMMARY OF THE INVENTION

Pursuant to the invention, shortcomings of conventional hermetically sealed coaxial RF feed-throughs, such as those described above, are effectively obviated by a new and improved hermetically sealed coaxial type RF feed-through architecture in which the connector's outer shell contains a relatively low coefficient of thermal expansion (CTE) portion that is soldered to a low CTE ferrule supporting a hermetically sealed longitudinal signal pin. The outer shell also includes a relatively high CTE portion that is readily joined as by welding to an adjacent support structure, such as a relatively high CTE aluminum housing and the like.

In accordance with a first (single pin) embodiment, a first portion of a longitudinal center pin is surrounded by and hermetically sealed against a generally cylindrical dielectric material, such as glass, from which projects an interior distal end of the pin. A second longitudinal portion of the center pin passes through a bore in a dielectric bushing and terminates at an exterior distal end thereof. The dielectric (glass) member adjoins and is hermetically sealed against a generally cylindrical ferrule. A first side of the ferrule adjoins a conductive spring member that serves as a portion of the conductive path for the cylindrical ground plane that surrounds the RF connector's center pin. A second side of the ferrule conforms with the shape of a depression in a first end portion of an outer shell. Rather than being welded to the outer shell, as in the prior art, the ferrule is soldered thereto along a solder interface between the second side of the ferrule and the adjoining surface of the end portion of the outer shell.

For this purpose, the first end portion of the outer shell is comprised of a material that has a CTE that is compatible with that of the ferrule. As a non-limiting example, the first end portion of the outer shell may comprise a ring of titanium that has been explosion welded to an adjacent ring of aluminum, which forms the remaining portion of the shell surrounding the dielectric bushing. Alternatively, the entirety of the outer shell may be made of a metal matrix composite, namely, a metal such as aluminum with ceramic particulate dispersed throughout its volume to change the physical characteristics of the metal. As a non-limiting example, the outer shell may be comprised of a material such as aluminum having a relatively high CTE that is compatible with the next outer structural layer (e.g., aluminum) to which the outer shell will be welded. In this case, in the vicinity of the ferrule the aluminum material of the outer shell is impregnated with a material, such as silicon, so that the first end portion of the outer shell is a composite material having a relatively low CTE that closely matches the CTE of the (KOVAR (Reg. Tdmk)) ferrule. The solder material may comprise any solder that is CTE-compatible with the materials it joins, such as tin-lead, or gold-tin solder as non-limiting examples.

As in the coaxial RF connectors of the prior art, the interior cylindrical surfaces of the outer shell and the ferrule are plated with a very low resistance metal, such as gold, to reduce the resistance of the ground plane layer that surrounds center pin. Because of the ability to flow the solder in the course of forming the solder joint between the ferrule and the outer shell, there is no need for an electrically conductive gasket.

In a practical implementation of the single pin embodiment of the invention, a dual threaded coaxial RF feed-through connector may have an outer shell comprising a composite material of silicon-loaded aluminum, with the silicon loading being relatively dense or high in the vicinity of its glass-sealed ferrule, and then tapering off to a low density at the two exterior ends of the RF connector. Such a structure exhibits a relatively low CTE adjacent to the glass-sealed ferrule, so that it may be soldered to a compatible low CTE ferrule at that location, and a relatively high CTE at its two exterior ends, so as to allow the RF connector to be readily interfaced with a housing or bulkhead made of a relatively high CTE material, such as unloaded aluminum.

The underlying functionality of the architecture of the present invention may also be applied to a multi-pin embodiment of a feed-through connector that employs a composite outer shell, so as to facilitate its being soldered to a low CTE insert in which a plurality of signal pin-sockets are supported and hermetically sealed against dielectric filled cylindrical slots through the insert. In this embodiment, the multi-pin feed-through connector comprises an outer support shell containing an arrangement of pins that are to insertable into associated sockets at exterior distal ends of and being solid with an arrangement of generally longitudinal conductive pins. These pins are retained within apertures of a low CTE insert member, hermetically sealed therein by means of a suitable dielectric such as glass. The insert is soldered to an interior end portion of the outer support shell. A major portion of outer support shell may comprise a high CTE material such as aluminum that is loaded in the vicinity of its interface/solder joint with the insert with ceramic particulate material such as silicon to lower the CTE of the aluminum so as to effectively match the CTE of the insert.

In a further embodiment of the invention the Teflon bushing is dispensed with and the center conductor pin projects from opposite ends of a hermetically sealing dielectric glass sleeve between an exterior distal end and an interior distal end thereof. With the pin hermetically sealed to an interior bore of the glass sleeve a generally 'L' cross-section shaped insert of KOVAR (Reg. Tdmk) is hermetically sealed to the outer surface of the glass sleeve. An outer shell has a first region of relatively low CTE material such as titanium that has been explosion welded to a second ring-configured region of relatively high CTE material, such as aluminum. Alternatively, as in the previous embodiments, the entirety of the outer shell may be made of aluminum, with the first region being heavily doped with silicon particles to lower the CTE of the first region relative to the CTE of the ring region. The outer shell is joined to the KOVAR (Reg. Tdmk) sleeve by a solder joint and may be welded to an aluminum housing. A contact spring is provided on the KOVAR (Reg. Tdmk) sleeve adjacent the interior distal end of the pin.

An additional single pin embodiment of a connector in accordance with the present invention further employs a first socket that is sized to receive the longitudinal pin on the interior side of the connector, and a second socket sized to receive a pin from an external connector. The connector of this additional embodiment has a pair of externally threaded regions of dissimilar metals (e.g., titanium and stainless steel) disposed at opposite ends of the connector, and a generally central ring-configured region of a high CTE metal, such as aluminum, between the externally threaded regions, so as to allow the connector to be welded to an associated high CTE housing. The connector pin is again hermetically sealed within a glass cylinder which, in turn, is hermetically sealed with a KOVAR (Reg. Tdmk) metal insert or sleeve. In accordance with the invention, a threaded region of low CTE material may be explosion welded to the high CTE aluminum ring-configured region, or the two regions may be made of the same material, such as aluminum, with one region containing a dispersion of ceramic particulates, such as a distribution of silicon particles, to lower the CTE of that region. The generally central ring-configured region may similarly be explosion-welded to a threaded stainless steel region. A generally cylindrical bore passes through the interiors of these three regions and is sized to receive a dielectric cylindrical plug that retains therein a dual socket-containing cylindrical metallic plug which is made of a conductive material such as copper. A first coaxial socket of the metallic plug extends to the exterior ambient of the connector and is adapted to receive the center pin of a plug to be threaded onto the threads of the stainless steel region. The opposite end of the plug contains a second coaxial socket which is sized to receive and engage the single conductor pin. The single pin connector of this additional embodiment has an outer metallic shell comprised of the three regions, one of which has a relatively low CTE, and a third flange shaped region of which has a second CTE, higher than that of the other regions. The outer metallic shell has an aperture sized to receive a conductor pin-retaining metallic (KOVAR (Reg. Tdmk)) insert which has a third CTE on the order of said second CTE, and being hermetically sealed against dielectric (glass) member. A generally longitudinal and coaxial aperture extends through the dielectric member and is sized to receive and be hermetically sealed with a conductor pin, with a solder joint formed between the second portion of the outer metallic shell and the metallic insert. Thus, like the other embodiments, this embodiment has its solder joint between a pair of relatively low CTE materials, and its attachment region to an external housing and the like made of relatively high CTE material.

Pursuant to a further embodiment of the invention, the Teflon bushing is dispensed with, and the interior of the KOVAR (Reg. Tdmk) insert is threaded. In this embodiment, the hermetically sealing dielectric (glass) region extends over a portion of the center conductor pin between an exterior distal end and an interior distal end thereof. With the pin hermetically sealed to an interior bore of the glass sleeve, a generally zig-zag cross-section shaped, internally threaded insert made of KOVAR (Reg. Tdmk) is hermetically sealed to the outer surface of the glass sleeve. An outer shell of composite aluminum has a first region of relatively low CTE material, such as particulate silicon heavily dispersed into the aluminum, or a low CTE metal layer such as titanium that has been explosion welded to a second ring-configured region of relatively high CTE material, such as aluminum, to facilitate welding of the outer shell to a high CTE housing, such as an aluminum housing. The outer shell is joined to the internally threaded KOVAR (Reg. Tdmk) sleeve by a solder joint. A contact spring is provided on the KOVAR (Reg. Tdmk) sleeve adjacent the interior distal end of the pin.

According to a further embodiment of the invention, the architecture of the multi-pin embodiment of the feed-through RF connector is modified by the incorporation of a composite outer support ring, that contains adjacent zones of high CTE metal and low CTE metal, so as to facilitate its being soldered to a low CTE main support shell in which a plurality of signal pin-sockets are supported and hermetically sealed against dielectric filled cylindrical slots extending through the shell. The multi-pin feed-through RF connector of this additional embodiment comprises a main low CTE support shell containing a pair of tapped holes that are used to attach a companion external plug connector having an arrangement of pins that are to insertable into associated sockets at exterior distal ends of wider diameter portions of generally longitudinal conductive pins. The pins are retained within bores of the low CTE main support shell (which may made of a material such as KOVAR (Reg. Tdmk) or stainless steel, for example) and hermetically sealed therein by means of a suitable dielectric such as glass. The main shell is soldered to an interior end portion of the composite outer support ring by means of a suitable solder such as tin-lead, or gold-tin solder as described above. As in the previously described multipin embodiment, being made of a composite material, the outer support shell may comprise a high CTE material such as aluminum that is selectively loaded with silicon particulate in the vicinity of its interface/solder joint with the low CTE support casing, the ceramic particulate material such as silicon serving to lower the CTE of the aluminum at that joint location so as to effectively match the CTE of the casing. Alternatively, the outer support shell may contain a portion of aluminum that has been explosion welded to a low CTE metal such as titanium, so as to provide low CTE metals on either side of the solder joint.

In addition to improving the architecture of a hermetically sealed single pin or multipin conductor, the dual CTE support structure according to the present invention may also be employed to construct improved microwave window structures. Pursuant to the present invention, advantage is taken of the use of a low CTE metal as part of the support structure to provide a metal layer-compatible solder joint between metal plated around the periphery of the microwave window material and the low CTE metal to which it is soldered. To this end a generally annular frame may be formed by bonding a pair of generally annular configured frame members together, such as by explosion welding, where dissimilar metals are employed, or by permeating to a partial depth in a common annular frame of a material such as aluminum so as to form respective zones of different ceramic (e.g., silicon) doping concentrations, thereby realizing two adjacent zones having respectively different CTEs. The high CTE zone is compliant with a relatively high CTE material, so as to facilitate welding the aluminum zone to a surrounding support structure; the other zone has a relatively low CTE, and facilitates soldering of that low CTE annular zone to metalized plating that has been plated along the periphery of the microwave window. The material of the microwave window may be any selected from those conventionally employed in microwave window applications, such as glass, quartz, sapphire, and aluminum oxide, as non-limiting examples. The window is sized to be received by and fit within a recess formed in the upper surface of the low CTE layer zone so as to enhance the formation of a solder-based hermetic seal along the periphery of the frame.

BRIEF DESCRIPTION OF THE DRAWINGS

FIG. 12 illustrates the ability of the invention to take a standard glass connector and make it compatible with a welding to a high CTE housing;

DETAILED DESCRIPTION OF THE PREFERRED EMBODIMENTS

Figure 4:
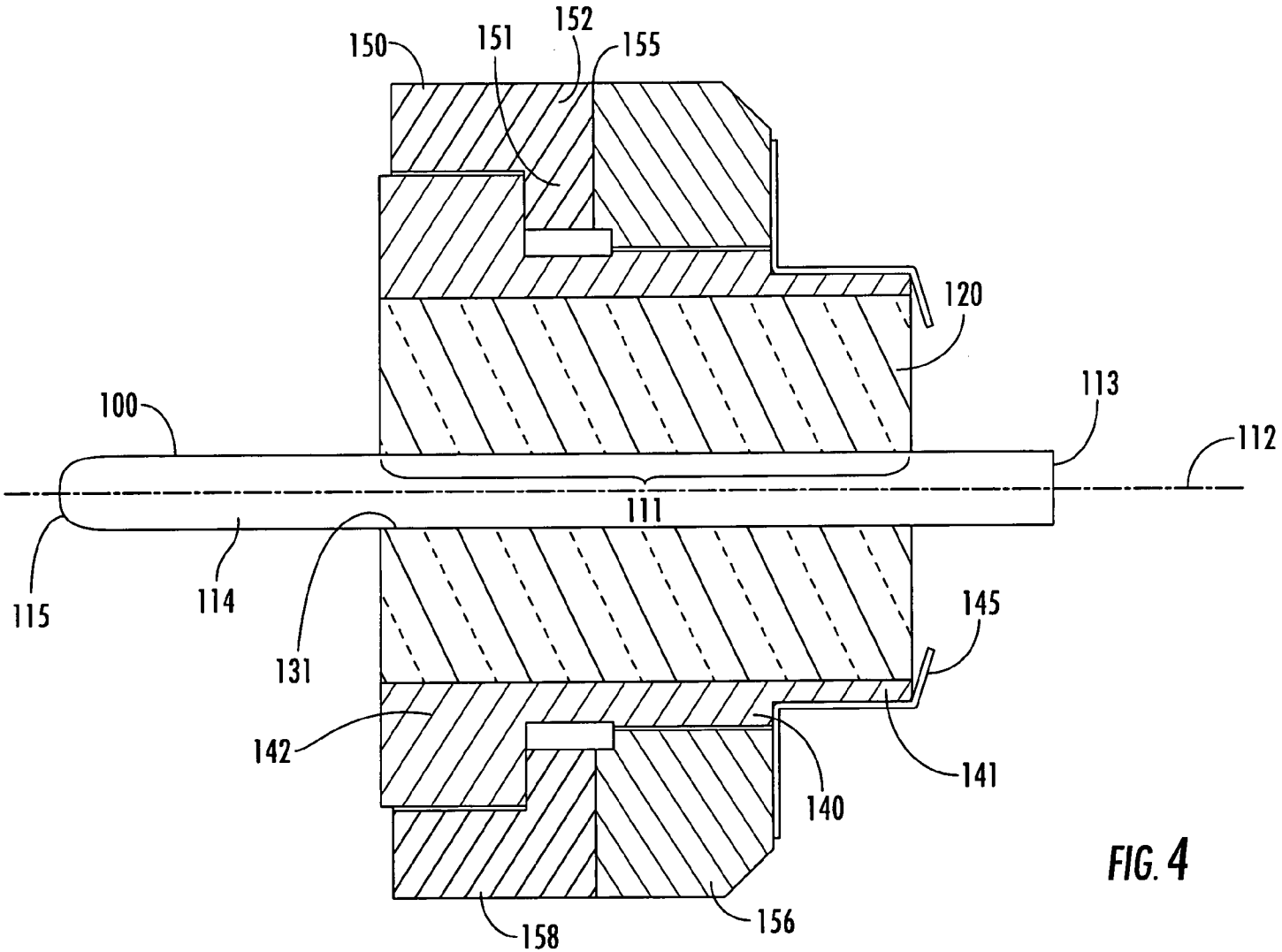
FIG. 4 diagrammatically illustrates the architecture of a hermetically sealed coaxial type RF feed-through connector in accordance with a first single-pin embodiment of the present invention.

Attention is now directed to FIG. 4, wherein a first single-pin embodiment of a hermetically sealed coaxial type RF feed-through connector in accordance with the invention is diagrammatically illustrated in cross-section as comprising a generally longitudinal center signal pin 100, which may be made of gold-plated KOVAR (Reg. Tdmk), and having a longitudinal axis which is coaxial with the longitudinal axis 112 of the coaxial feed-through RF connector. As in the previous FIGS., center pin 100, as well as the remaining components of the RF connector, are cylindrically symmetrical about the RF connector's axis 112. A first longitudinal portion 111 of the center pin 110 is surrounded by and hermetically sealed against a bore 131 of a generally cylindrical glass member 120, from which projects an interior distal end 113 of the pin 10. A second longitudinal portion 114 of the center pin 100 projects from an opposite end of bore 131 and terminates at an exterior distal end 115.

Figure 1:
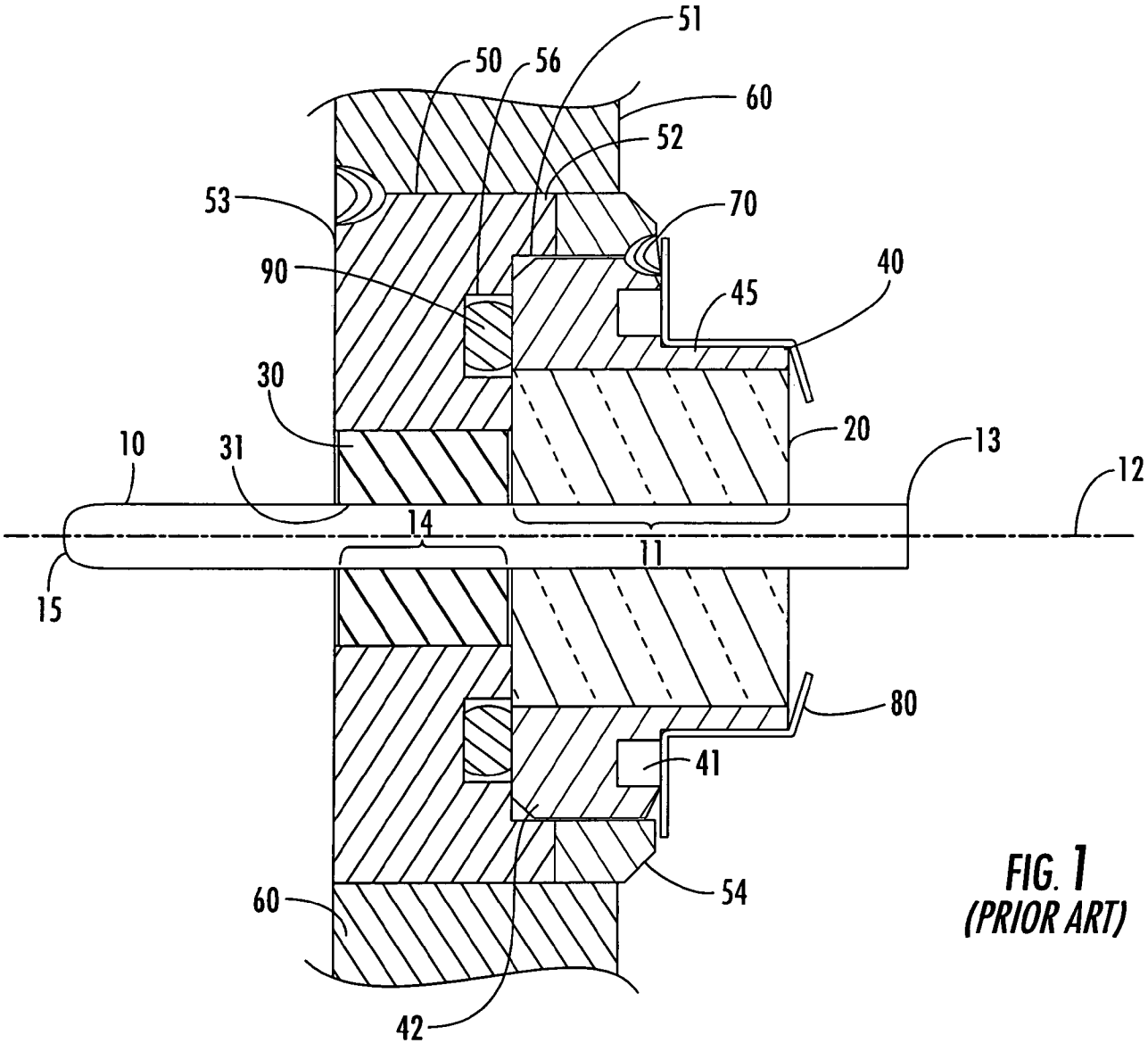
FIG. 1 (PRIOR ART)
FIG. 1 diagrammatically illustrates the architecture of a conventional hermetically sealed coaxial type RF feed-through connector.

The glass member 120 adjoins and is hermetically sealed against a generally cylindrical KOVAR (Reg. Tdmk) ferrule 140, having a generally 'T' shaped cross-section. A first side 141 of the ferrule adjoins a conductive spring member 145, that serves as a portion of the conductive path for the cylindrical ground plane that surrounds the RF connector's center pin 100, in the same manner as the contact spring 90 of the conventional coaxial RF connector described above in FIG. 1. A second side 142 of the ferrule 140 conforms with the shape of a depression or groove 151 in a first end portion 152 of an outer shell 150. In accordance with the invention, rather than being welded to the outer shell, ferrule 140 is soldered thereto along a solder joint or interface 155 between the second side 142 of the ferrule 140 and the adjoining surface of the first end portion 152 of the outer shell.

For this purpose, the first end portion 152 of the outer shell 150 is comprised of a material that has a coefficient of thermal expansion (CTE) that is compatible with that of the ferrule 140. As a non-limiting example, the first end portion 152 of outer shell 150 may comprise a ring layer 156 of titanium that has been explosion welded to an adjacent ring layer 158 of aluminum, which forms the remaining portion of the outer shell 150 surrounding the Teflon bushing 130. Alternatively, the entirety of the outer shell 150 may be made of a metal matrix composite, namely, a metal such as aluminum with ceramic particulate dispersed throughout its volume to change the physical characteristics of the metal, with a higher loading of the particulate creating a greater physical change. As a non-limiting example the outer shell may be comprised of a material such as aluminum having a relatively high CTE that is compatible with the next outer structural layer (e.g., aluminum) to which the outer shell will be welded.

Figure 5:
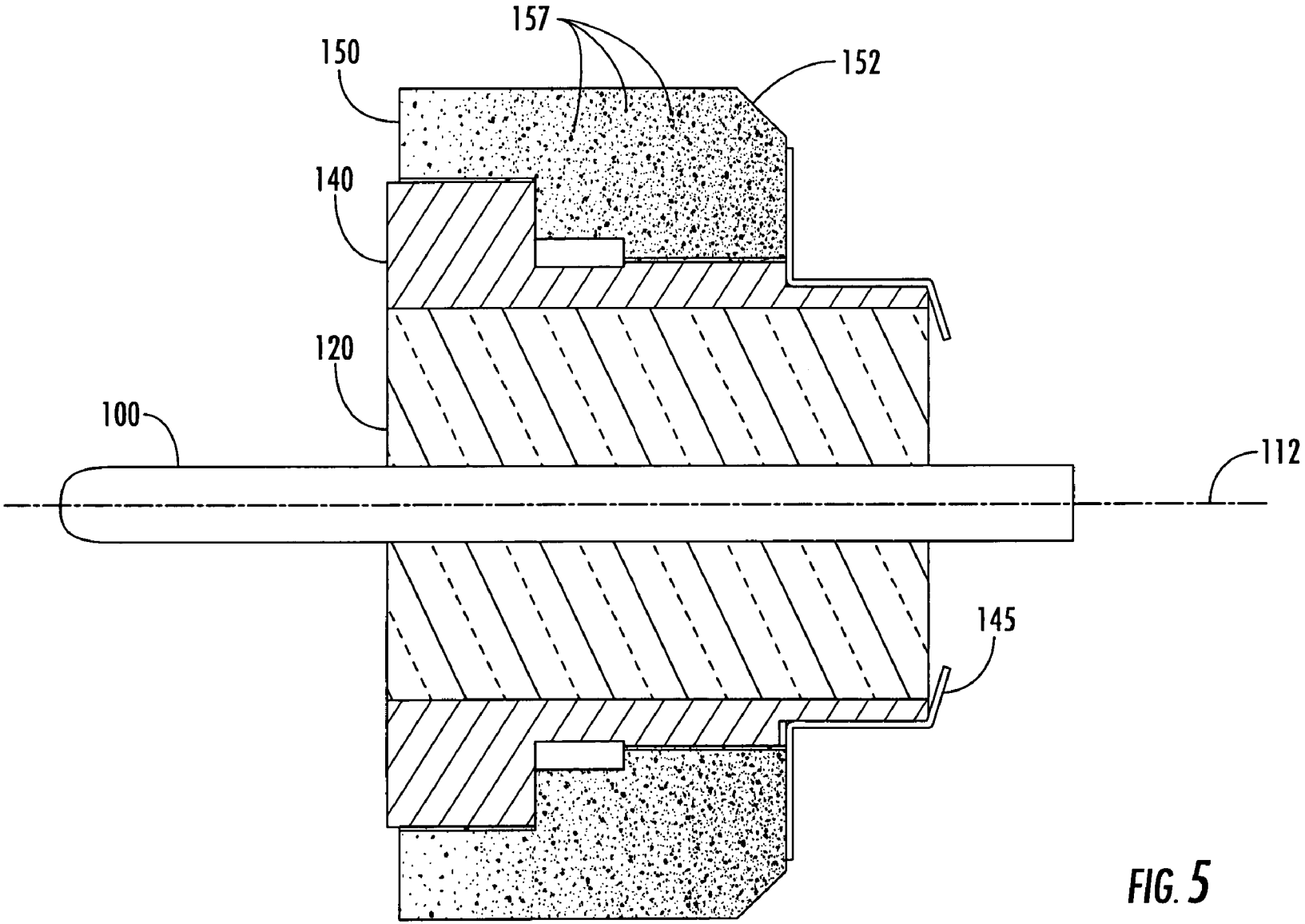
FIG. 5 diagrammatically illustrates the architecture of a hermetically sealed coaxial type RF feed-through connector in accordance with a second, single-pin embodiment of the present invention, wherein the material of the outer shell is impregnated with a material, such as silicon, so as to alter its CTE in the vicinity of the solder joint between the outer shell and the hermetically sealed ferrule.

In this case, as shown in FIG. 5, which depicts a second single-pin embodiment of a hermetically sealed coaxial type feed-through RF connector in accordance with the invention, in the vicinity of the ferrule 140, the aluminum material of the outer shell is impregnated with a material 157, such as silicon, so that the first end portion 152 of the outer shell is a composite material having a relatively low CTE that closely matches the CTE of the (KOVAR (Reg. Tdmk)) ferrule 140. The solder material may comprise any solder that is CTE compatible with the materials it joins, such as tin-lead, or gold-tin solder as non-limiting examples.

As in the coaxial RF connectors of the prior art, the interior cylindrical surfaces of outer shell 150 and ferrule 140 are plated with very low resistance metal, such as gold, to reduce the resistance of the ground plane layer that surrounds center pin 100. Because of the ability to flow the solder in the course of forming the solder joint between ferrule 140 and outer shell 150, there is no need for an electrically conductive gasket, as in the prior art described above. In addition, there is no need to mask plating as in the prior art since solder is compatible with the plating.

Figure 6:
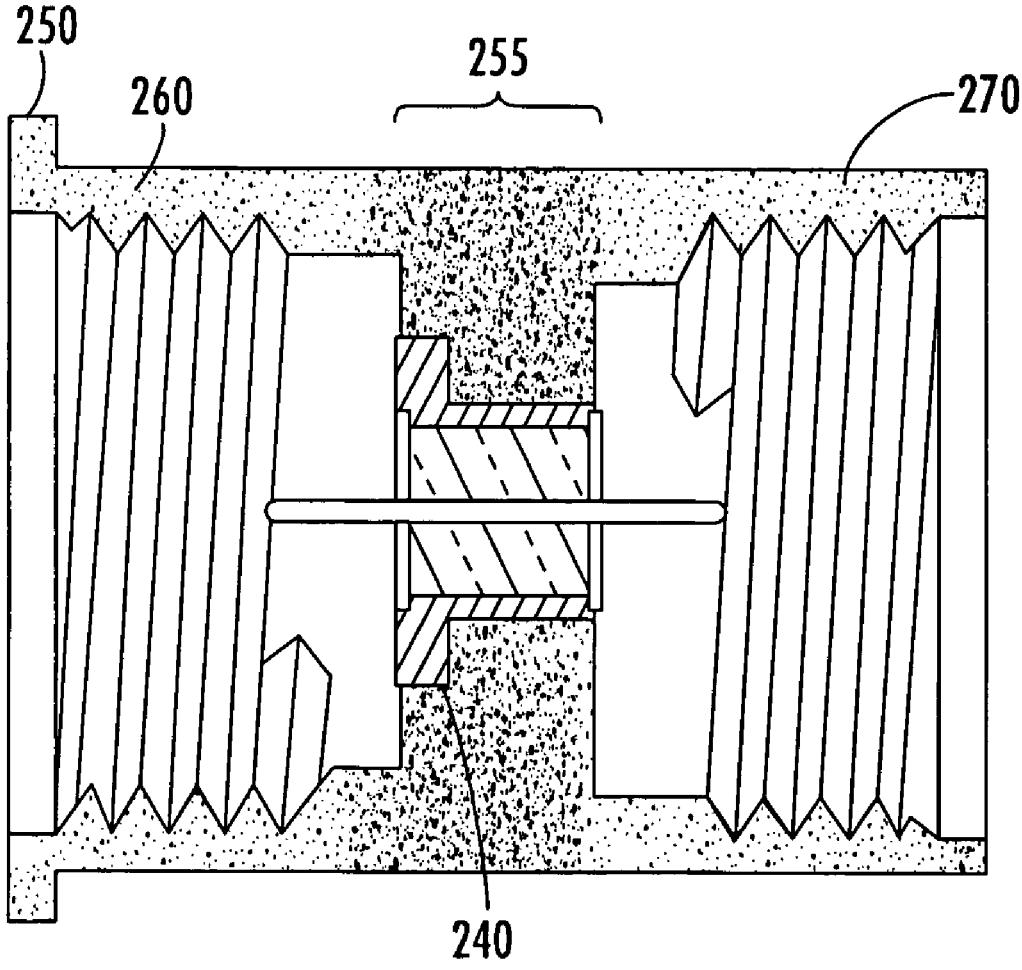
FIG. 6 diagrammatically illustrates an example of a dual threaded coaxial RF feed-through connector that employs the architectural features of the single-pin embodiment shown in FIGS. 4 and 5.

FIG. 6 diagrammatically illustrates an example of a dual threaded coaxial RF feed-through that employs the architectural features of the single-pin embodiment shown in FIG. 5, described above. In this example, as in the embodiment of FIG. 5, an outer shell 250 comprises a composite material of silicon-loaded aluminum, with the silicon loading being relatively dense or high in the vicinity 255 of its glass-sealed ferrule 240, and then tapering off to a low density at the two exterior ends 260 and 270 of the RF connector. Such a structure exhibits a relatively low CTE adjacent to the glass-sealed ferrule, so that it may be soldered to a compatible low CTE ferrule at that location, and a relatively high CTE at its two exterior ends, so as to allow the RF connector to be readily interfaced with a housing or bulkhead made of a relatively high CTE material, such as unloaded aluminum.

Figure 7:
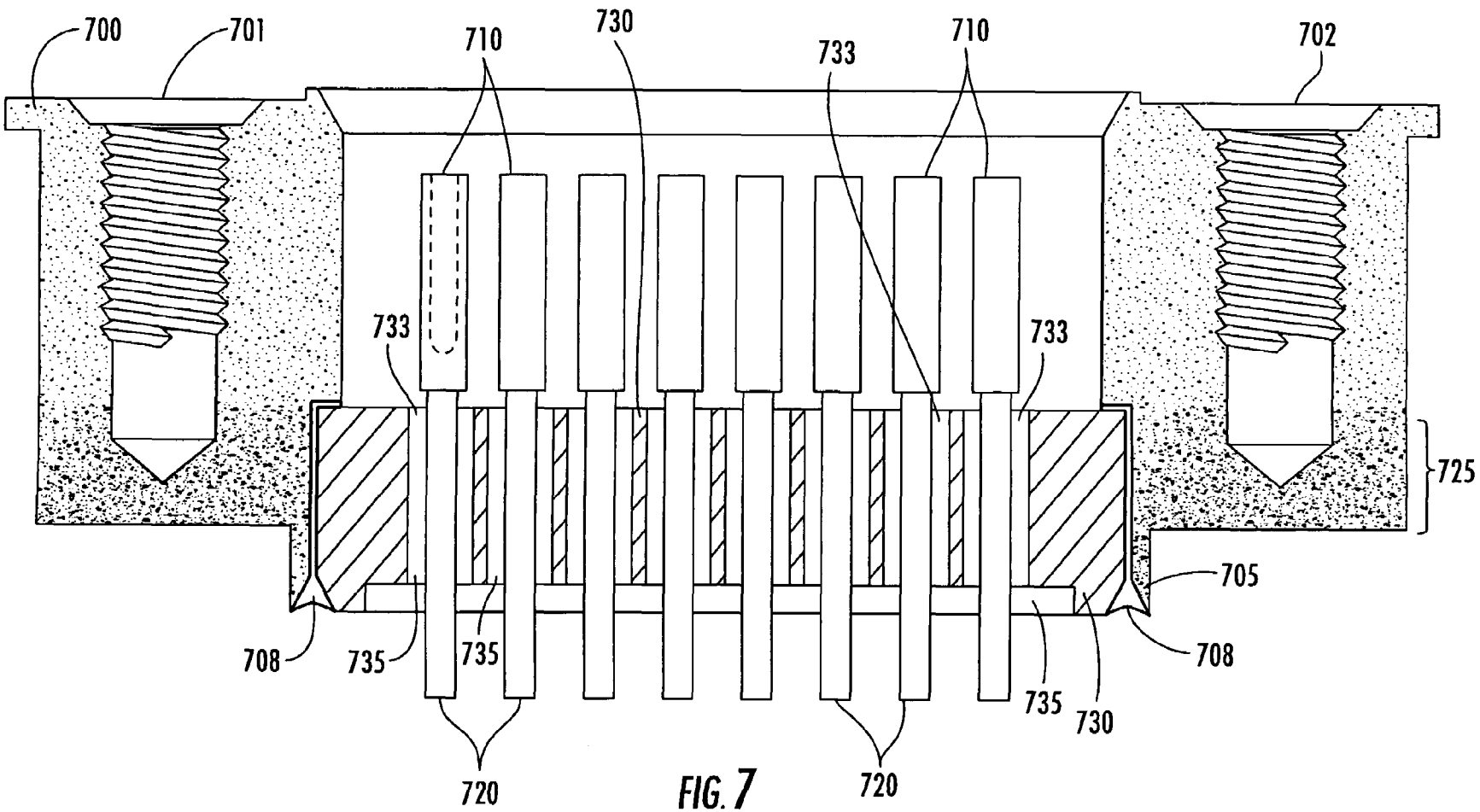
FIG. 7 is a diagrammatic cross-sectional view of a multi-pin embodiment of an RF feed-through connector that employs a composite outer shell, so as to facilitate its being soldered to a low CTE insert in which a plurality of signal pin-sockets are supported and hermetically sealed against dielectric filled cylindrical slots through the insert.

FIG. 7 is a diagrammatic cross-sectional view of a multi-pin embodiment of an RF feed-through connector that employs a composite outer shell, so as to facilitate its being soldered to a low CTE insert in which a plurality of signal pin-sockets are supported and hermetically sealed against dielectric filled cylindrical slots through the insert. As shown in FIG. 7, the multi-pin feed-through RF connector comprises an outer support shell or casing 700 containing a pair of tapped holes 701 and 702 that are used to attach a companion external plug RF connector (not shown) containing an arrangement of pins that are to insertable into associated sockets 710 at exterior distal ends of and being solid with an arrangement of generally longitudinal conductive pins 720.

Pins 720 are retained within bores 735 of a low CTE insert member 730 (made of a material such as stainless steel, as a non-limiting example) and hermetically sealed therein by means of a suitable dielectric such as glass 733. The insert 730 is soldered to an interior end portion 705 of the outer support shell 700 by means of a suitable solder 708 such as tin-lead, or gold-tin solder as described above. As in the embodiment of FIG. 6, being made of a composite material, a major portion of outer support shell 700 may comprise a high CTE material such as aluminum that is loaded in the vicinity 725 of its interface/solder joint 708 with the insert 730 with ceramic particulate material such as silicon to lower the CTE of the aluminum so as to effectively match the CTE of the insert member 730.

Figure 8:
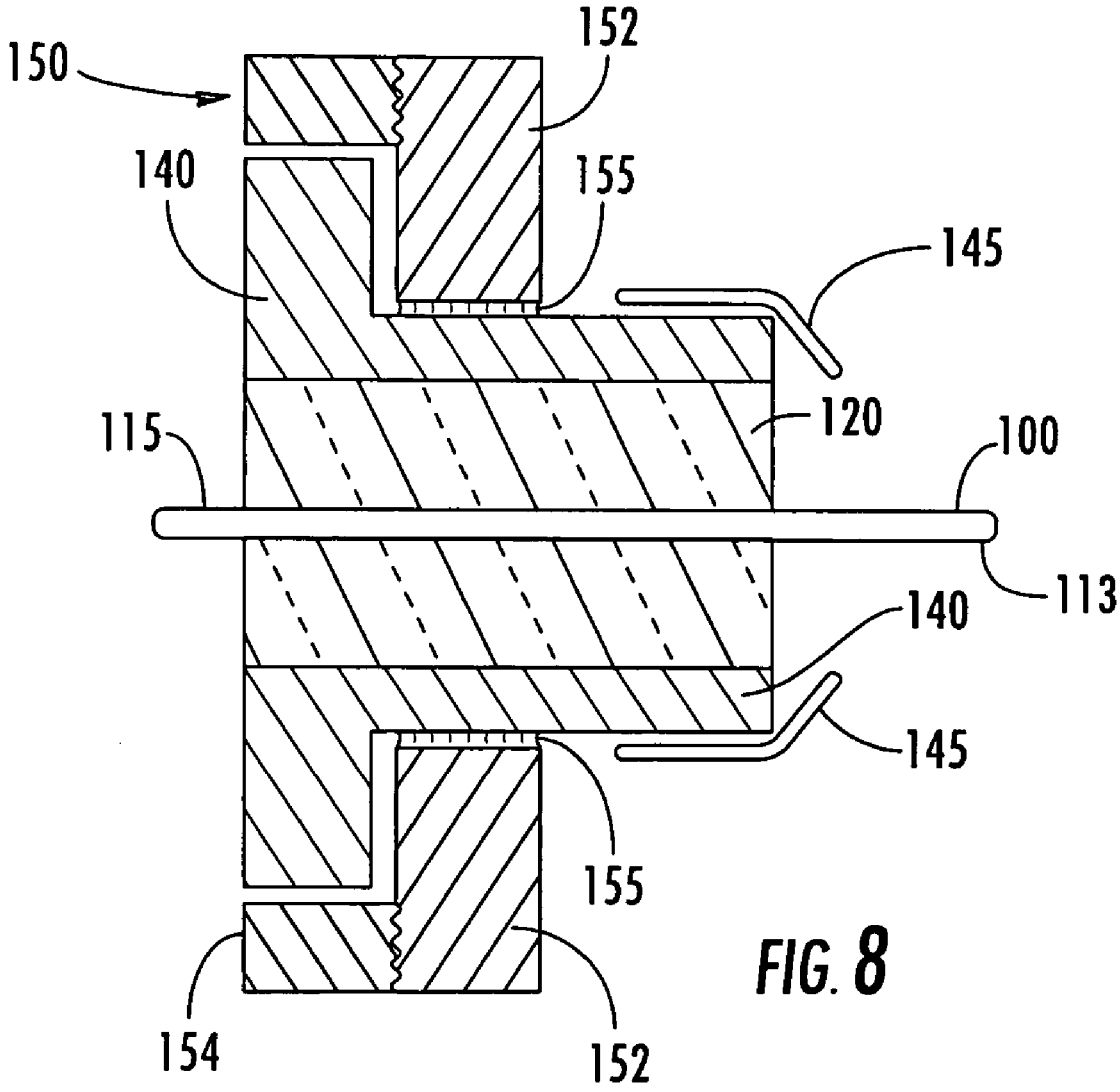
FIG. 8 diagrammatically illustrates a further embodiment of the invention which is similar to the embodiments of FIGS. 4 and 5, but omits the Teflon bushing of those embodiments.

FIG. 8 diagrammatically illustrates a further embodiment of the invention which is similar to the embodiments of FIGS. 4 and 5, except that the Teflon bushing of those embodiments is dispensed with. In the embodiment of FIG. 8, the hermetically sealing dielectric (glass) sleeve region 120 extends over a portion of the center conductor pin 100 between an exterior distal end 115 and an interior distal end 113 thereof. With the pin 100 hermetically sealed to an interior bore of the glass sleeve 120, a generally 'L' cross-section shaped insert 140 made of (KOVAR (Reg. Tdmk) is hermetically sealed to the outer surface of the glass sleeve 120. An outer shell 150 has a first region 152 of relatively low CTE material such as titanium that has been explosion welded to a second ring-configured region 154 of relatively high CTE material, such as aluminum. Alternatively, as in the previous embodiments, the entirety of the outer shell 150 may be made of aluminum, with the first region 152 being heavily doped with ceramic (e.g., silicon particles) to lower the CTE of the first region 152 relative to the CTE of the ring region 154. The outer shell 150 is joined to the KOVAR (Reg. Tdmk) sleeve by a solder joint 155. A contact spring 145 is provided on the KOVAR (Reg. Tdmk) sleeve adjacent the interior distal end of the pin 100.

Figure 9:
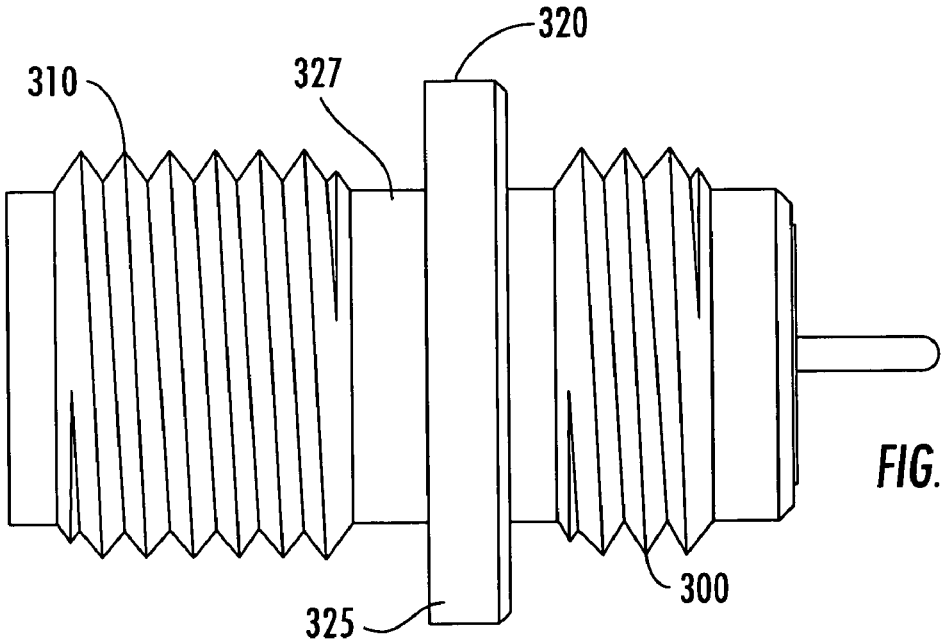
FIGS. 9, 10 and 11 diagrammatically illustrate an additional single pin embodiment of a connector in accordance with the present invention, which has an architecture somewhat similar to that shown in FIG. 6, employing a first socket that is sized to receive the longitudinal pin on the interior side of the connector, and a second socket sized to receive a pin from an external connector and which shows more than a dual layer for CTE customizing.
Figure 10:
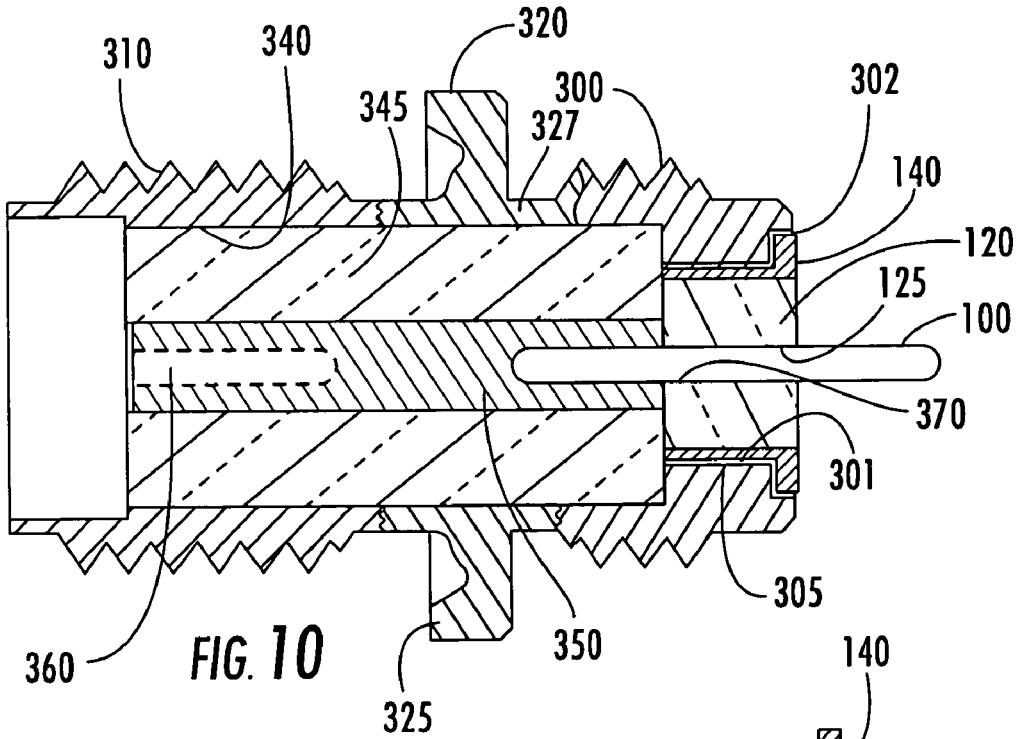
Figure 11:
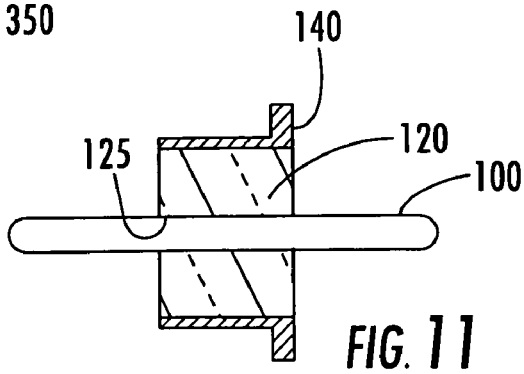

FIGS. 9, 10 and 11 diagrammatically illustrate an additional single pin embodiment of a connector in accordance with the present invention, which has an architecture somewhat similar to that shown in FIG. 6, described above, but further employing a first socket that is sized to receive the longitudinal pin on the interior side of the connector, and a second socket sized to receive a pin from an external connector. As shown in FIGS. 9 and 10, the connector has a pair of externally threaded regions 300 and 310 of dissimilar metals (e.g., titanium and stainless steel) disposed at opposite ends of the connector, and a generally central region 320 of a high CTE metal having a ring-configured flange portion 325 extending from a generally cylindrically-shaped sleeve portion 327, that is joined with externally threaded regions 300 and 310, such as aluminum, between the externally threaded regions 300 and 310, to allow the connector to be welded to an associated high CTE housing, as in the other embodiments described above.

As shown in FIGS. 10 and 11, the connector pin 100 is hermetically sealed within a glass cylinder 120 which, in turn, is hermetically sealed with a KOVAR (Reg. Tdmk) metal insert or L-shaped sleeve 140. The structure of FIG. 11 is inserted into and soldered to a bore 301 (FIG. 10) of threaded region 300. The solder line between the KOVAR (Reg. Tdmk) sleeve 140 and the bore 301 of the threaded region 300 is shown in FIG. 10 at 302. In accordance with the invention, threaded region 300 is comprised of low CTE material, such as threaded sleeve of titanium that has been explosion welded to the high CTE aluminum ring-configured region 320. The two regions 300 and 320 may alternatively be made of the same material, such as aluminum, and region 300 may contain therein a dispersion of ceramic particulates, such as a distribution of silicon particles, to lower the CTE of the region 300, as compared to the higher CTE of region 320.

The generally central ring-configured region 320 may similarly be explosion-welded to the threaded (stainless steel) region 310. As seen in FIG. 10, a generally cylindrical bore 340 passes through the interiors of regions 300, 310 and 320, and is sized to receive a dielectric (e.g., Teflon) cylindrical plug 345 that retains therein a dual socket-containing cylindrical metallic plug 350, which is made of a conductive material such as copper. A first coaxial socket 360 of the metallic plug 350 is shown as extending to the exterior ambient of the connector and is adapted to receive the center pin of a plug to be threaded onto the threads of (stainless steel) region 310. The opposite end of the plug 350 contains a second coaxial socket 370, which is sized to receive and engage the pin 100.

As in the embodiments described above, the single pin connector of FIGS. 9, 10 and 11 has an outer metallic shell comprised of regions 300, 310 and 320, a first portion (regions 310 and 320) of which has a relatively high coefficient of thermal expansion (CTE), and a second portion (region 300) of which has a second CTE, lower than that of regions 310 and 320, with the second portion 300 of the outer metallic shell having an aperture 305 sized to receive a conductor pin-retaining metallic (KOVAR (Reg. Tdmk)) insert 140, which has a third CTE on the order of said second CTE, and being hermetically sealed against dielectric (glass) member 120 as shown in FIG. 10. As shown in FIGS. 10, 11 a generally longitudinal and coaxial aperture 125 extends through the dielectric member 120 and is sized to receive and be hermetically sealed with conductor pin 100, with the solder joint formed 302 between the second portion 300 of the outer metallic shell and the metallic insert 140. Thus, like the embodiments described above, the hermetically sealed connector architecture of FIGS. 9, 10 and 11 has its solder joint 302 between the pair of relatively low CTE material regions 140 and 300, and its attachment region to an external housing (by way of the generally ring-shaped flange portion 325) and the like made of relatively high CTE material.

Figure 12:
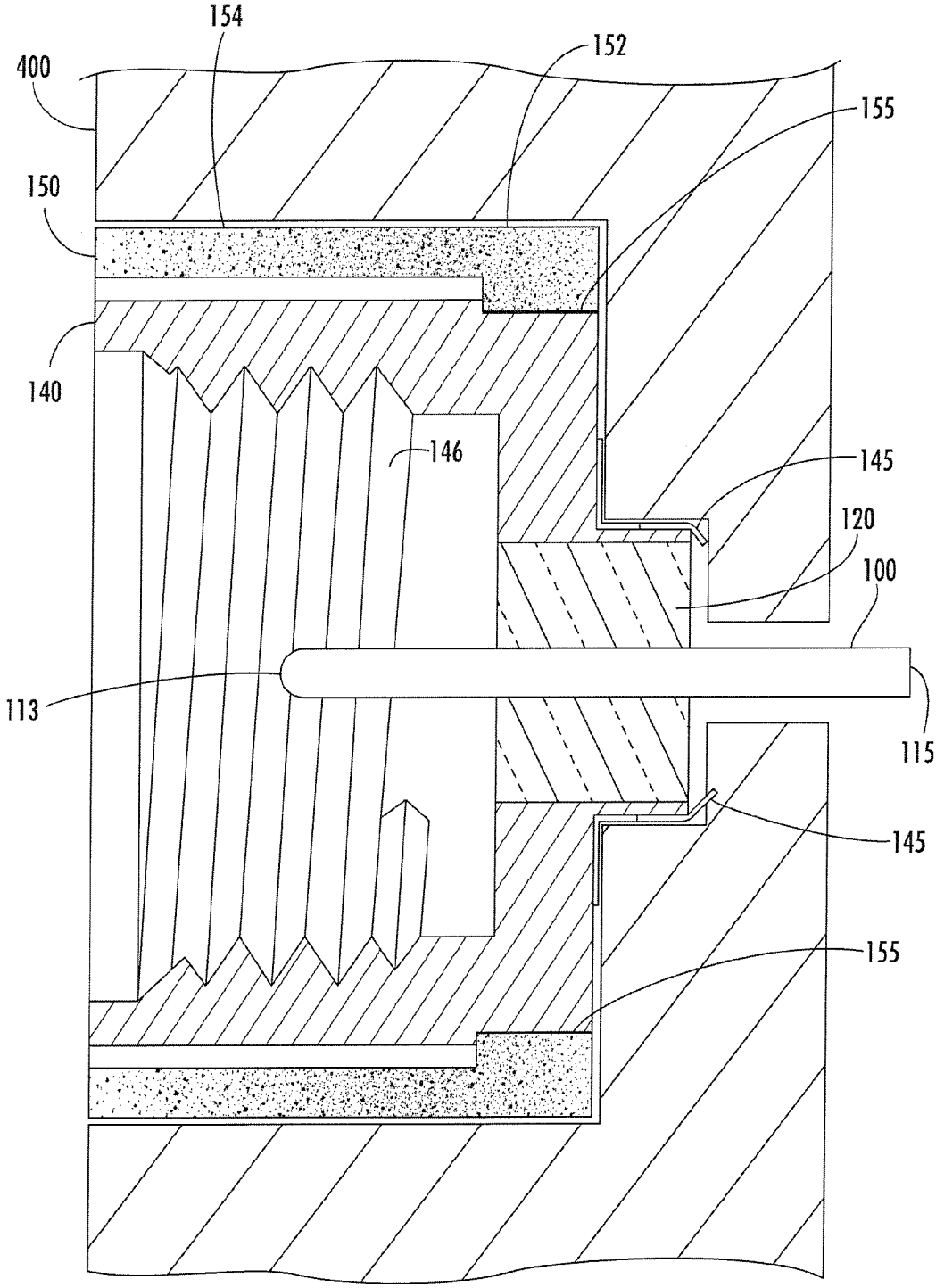
FIG. 12 diagrammatically illustrates another embodiment of the invention which is similar to the embodiments of FIGS. 4 and 5, except that the Teflon bushing of those embodiments is dispensed with, and the interior of the KOVAR (Reg. Tdmk) insert is threaded.

FIG. 12 diagrammatically illustrates another embodiment of the invention which is similar to the embodiments of FIGS. 4 and 5, except that the Teflon bushing of those embodiments is dispensed with, and the interior of the KOVAR (Reg. Tdmk) insert is threaded. More particularly, in the embodiment of FIG. 12 the hermetically sealing dielectric (glass) region 120 extends over a portion of the center conductor pin 100 between an exterior distal end 115 and an interior distal end 113 thereof. With the pin 100 hermetically sealed to an interior bore of the glass sleeve 120, a generally zig-zag cross-section shaped, internally threaded insert 140 made of KOVAR (Reg. Tdmk) is hermetically sealed to the outer surface of the glass sleeve 120. An outer shell 150 of aluminum has a first region 152 of relatively low CTE material, such as particulate silicon heavily dispersed into the aluminum, or a low CTE metal layer such as titanium that has been explosion welded to a second ring-configured region 154 of relatively high CTE material, such as aluminum, to facilitate welding of the outer shell to a high CTE housing, such as an aluminum housing 400. The outer shell 150 is joined to the internally threaded KOVAR (Reg. Tdmk) sleeve 140 by a solder joint 155. A contact spring 145 is provided on the KOVAR (Reg. Tdmk) sleeve adjacent the interior distal end of the pin 100.

Figure 13:
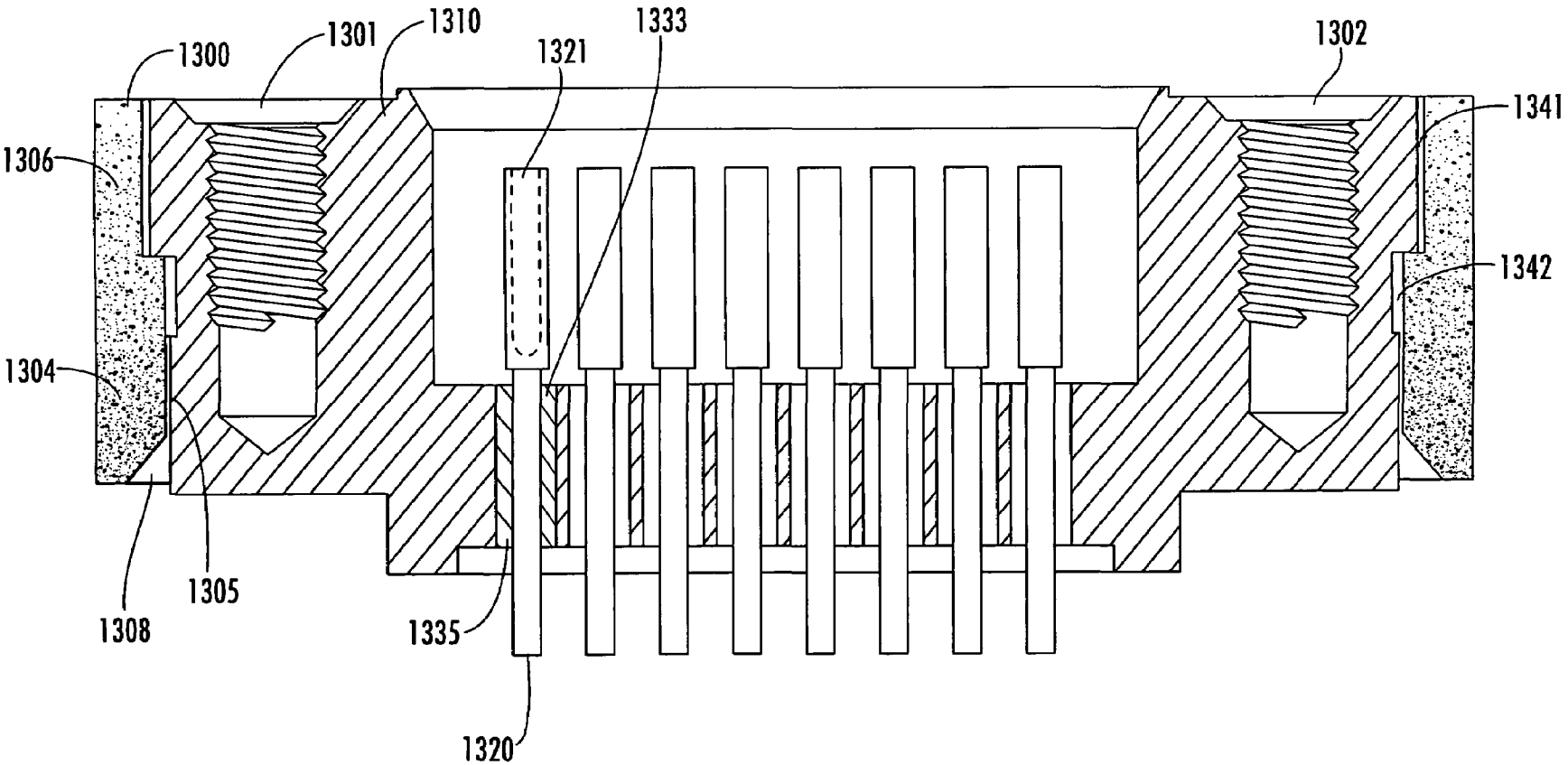
FIG. 13 is a diagrammatic cross-sectional view of a modification of the multi-pin embodiment of the feed-through RF connector shown in FIG. 7 described above, which employs a composite outer support ring, so as to facilitate its being soldered to a low CTE main support shell in which a plurality of signal pin-sockets are supported and hermetically sealed against dielectric filled cylindrical slots extending through the shell, again, converting a standard low expansion connector to be compatible with a high expansion housing.

FIG. 13 is a diagrammatic cross-sectional view of a modification of the multi-pin embodiment of the feed-through connector shown in FIG. 7 described above, which employs a composite outer support ring 1300, so as to facilitate its being soldered to a low CTE main support shell 1310 in which a plurality of signal pin-sockets are supported and hermetically sealed against dielectric filled cylindrical slots extending through the shell. As shown in FIG. 13, the multi-pin feed-through connector comprises a main low CTE support shell or casing 1310 containing a pair of tapped holes 1301 and 1302 that are used to attach a companion external plug connector (not shown) having an arrangement of pins that are to insertable into associated sockets 1321 at exterior distal ends of wider diameter portions of generally longitudinal conductive pins 1320. As in the architecture of the multipin embodiment of FIG. 7, the pins 1320 are retained within bores 1335 of the low CTE main support shell (which may made of a material such as KOVAR (Reg. Tdmk) or stainless steel, as non-limiting examples) and hermetically sealed therein by means of a suitable dielectric such as glass 1333.

The main shell 1310 is soldered to an interior end portion 1305 of the composite outer support ring 1300 by means of a suitable solder 1308 such as tin-lead, or gold-tin solder as described above. A pair of air gaps 1341 and 1342 serve to inhibit solder flow and tend to concentrate the solder in the region 1305 where the silicon doping of the aluminum has its highest density. As in the embodiment of FIG. 7, being made of a composite material, outer support shell 1300 may comprise a high CTE material such as aluminum that is selectively loaded with silicon particulate in the vicinity 1304 of its interface/solder joint 1308 with the low CTE support casing 1310, the ceramic particulate material such as silicon serving to lower the CTE of the aluminum at that joint location so as to effectively match the CTE of the casing 1310. Alternatively, the outer support shell may contain a portion of aluminum at 1306 that has been explosion welded to a low CTE metal such as titanium at 1304, so as to provide low CTE metals on either side of the solder joint 1305.

As described briefly above, in addition to improving the architecture of a hermetically sealed single pin or multipin conductor, the dual CTE support structure according to the present invention may also be employed to construct improved microwave window structures. This may be readily appreciated by considering the architecture of a conventional microwave window, such as that disclosed in the U.S. patent to Taylor et al U.S. Pat. No. 5,986,208, the disclosure of which is incorporated herein. Attention may also be directed to the U.S. patent to Pollock, U.S. Pat. No. 5,936,494 for another example of a prior art microwave window structure.

Figure 2:
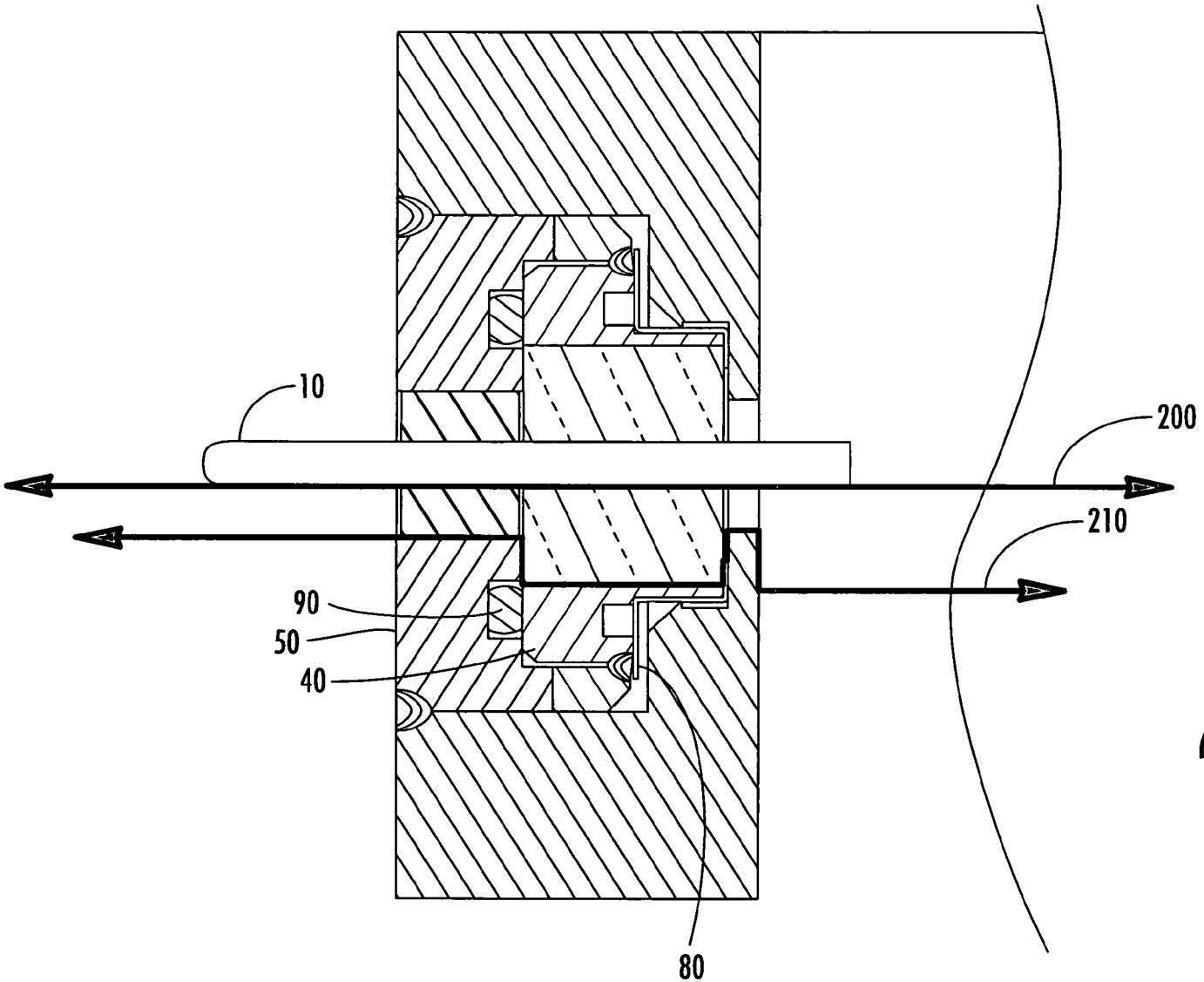
FIG. 2 (PRIOR ART)
FIG. 2 shows in bold signal and ground plane paths through the hermetically sealed coaxial type RF feed-through connector of FIG. 1.
Figure 3:
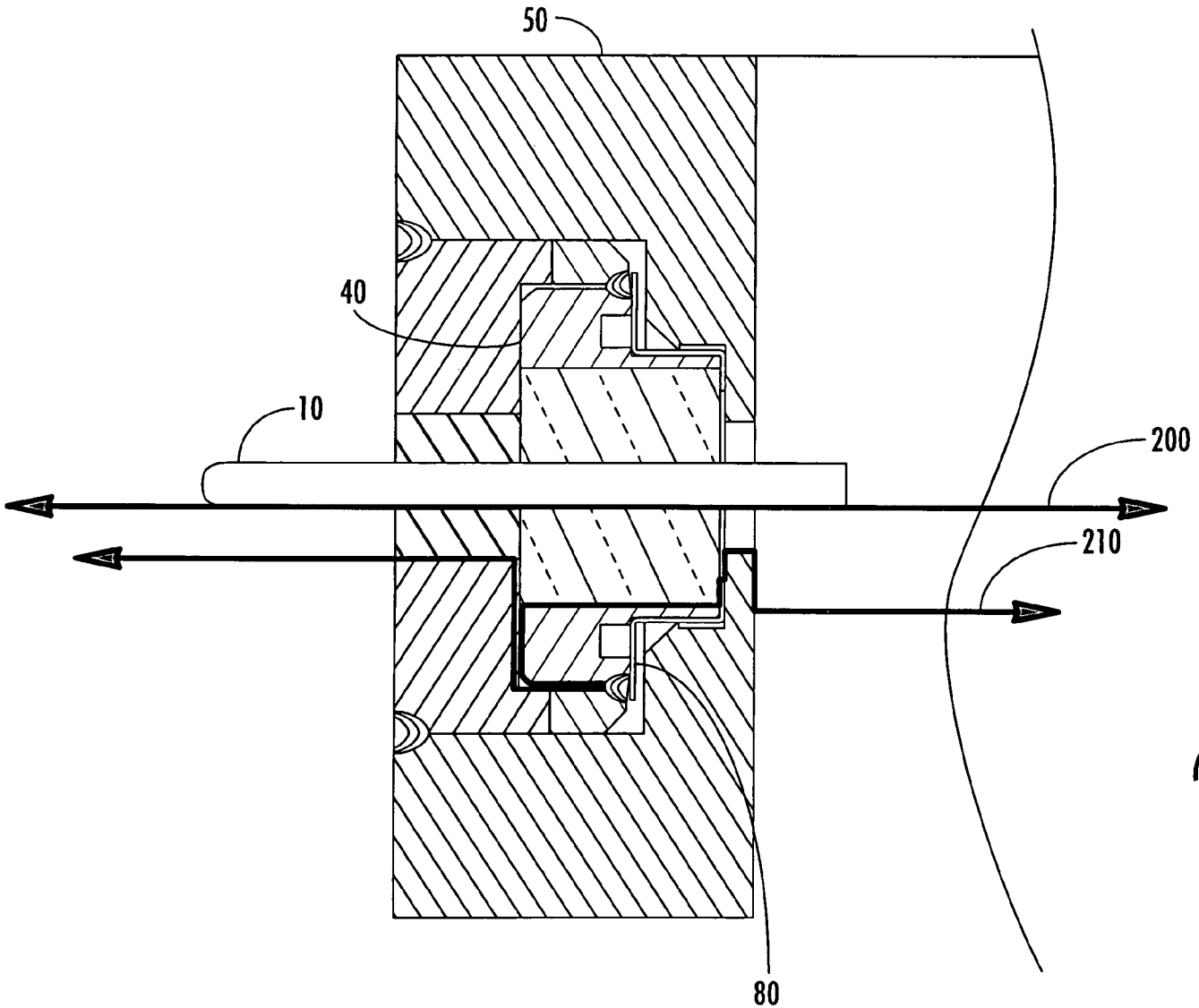
FIG. 3 (PRIOR ART)
FIG. 3 shows signal and ground plane paths through a modification of the hermetically sealed coaxial type RF feed-through connector of FIG. 1 from which the electrically conductive gasket has been removed.
Figure 14:
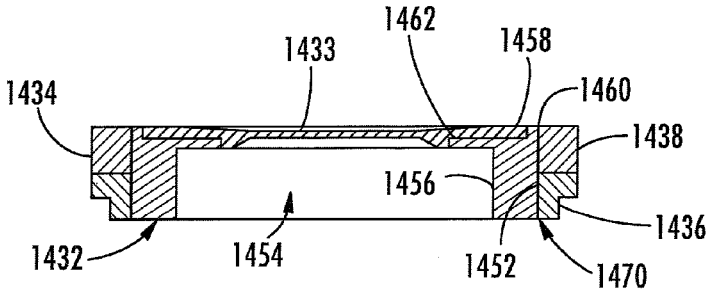
FIG. 14 (PRIOR ART)
FIG. 14 shows a cross-sectional view of a prior art waveguide window assembly and bimetallic bushing.
Figure 15:
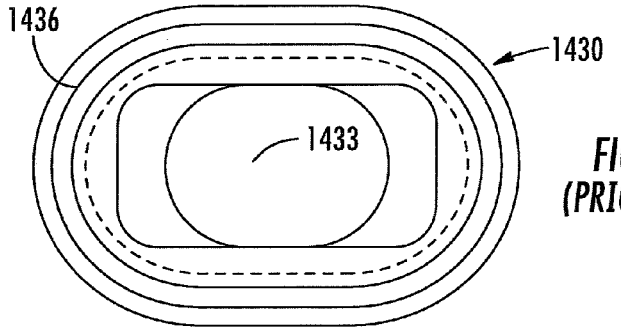
FIG. 15 (PRIOR ART)
FIG. 15 shows a top plan view of the prior art waveguide window structure of FIG. 14.

Attention is more particularly directed to FIGS. 14 and 15 of the drawings of the present application which correspond essentially to FIGS. 3 and 2, respectively, of the Taylor et al Patent. In these FIGS. parts of the drawings are identified with the prefix 14 followed by the two-digit number used in the patent. Thus, as shown in the side sectional view of FIG. 14 and the top view of FIG. 15, the microwave window structure 1430 (FIG. 15) of the Taylor et al Patent is comprised of a metallic window frame 1432 (FIG. 14), has a body having an outer periphery 1452 (FIG. 14) with a hollow cavity 1454 (FIG. 14) formed by sidewalls 1456 (FIG. 14). A shallow recess 1458 (FIG. 14) is formed by a thin peripheral lip 1460 (FIG. 14) and shoulder 1462 (FIG. 14) that is designed to interface with a glass window 1433 (FIG. 14 and in a standard fashion. A metallic bushing 1434 (FIG. 15) contains 15) a first material layer 1438 (FIG. 14) and a second material layer 1436 (FIGS. 14 and 15) that are preferably metallurgically bonded together, such as by explosively bonding two metallic layers. Layer 1438 (FIG. 14) is an aluminum alloy and, as such, has a relatively high CTE to facilitate welding of the bushing to a support structure therefore, while layer 1436 (FIGS. 14 and 15) is preferably constructed from KOVAR (Reg. Tdmk) or an iron/nickel alloy and, as such, has a relatively low CTE, to facilitate welding of the bushing to the frame as shown at weld joint 1470 (FIG. 15).

Figure 16:
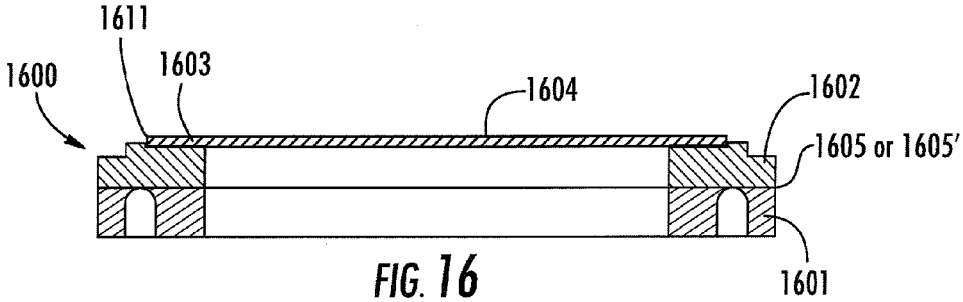
FIG. 16 shows a cross-sectional view of a waveguide window assembly in accordance with the present invention.
Figure 17:
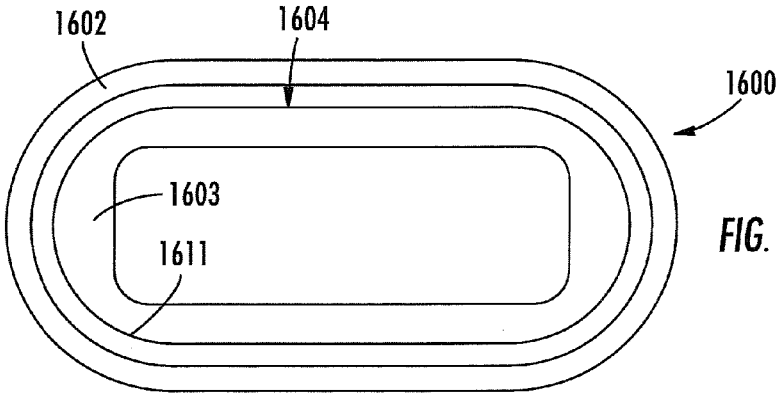
FIG. 17 shows a top plan view of the waveguide window structure of FIG. 15.

Pursuant to the present invention, advantage is taken of the use of a low CTE metal as part of the support structure to provide a metal layer-compatible solder joint between the microwave window material and the low CTE metal to which it is soldered. This may be readily understood by reference to FIGS. 16 and 17, which are respective side sectional and top views of a microwave window architecture in accordance with the invention. A generally annular frame 1600 is formed by bonding a pair of generally annular configured frame members 1601 and 1602 together at bond 1605, such as by explosion welding, where dissimilar metals are employed, or by permeating to a partial depth in a common annular frame of a material such as aluminum so as to form respective zones substantially above and below boundary 1605' of different ceramic (e.g., silicon) doping concentrations, to realize two adjacent zones having respectively different CTEs—one relatively high to facilitate welding the aluminum zone to a surrounding support structure (not shown), and the other being relatively low, so as to facilitate soldering of that low CTE annular zone to metalized plating that has been plated along the periphery 1603 of the microwave window 1604. The material of the microwave window 1604 may be any selected from those conventionally employed in microwave window applications, such as glass, quartz, sapphire, and aluminum oxide, as non-limiting examples. The window is sized to be received by and fit within a recess 1611 formed in the upper surface of the low CTE layer 1602, so as to enhance the formation of a solder-based hermetic seal along the periphery of the frame. Note that annular frame member 1601 includes an annular notch or groove having a depth which approaches boundary 1605'.

As will be appreciated from the foregoing description, shortcomings of conventional hermetically sealed coaxial RF feed-throughs, such as those described above, are effectively obviated by the hermetically sealed coaxial RF type feed-through connector architecture of the invention in which the connector's outer shell contains a relatively low coefficient of thermal expansion (CTE) portion that is soldered to a low CTE ferrule supporting a hermetically sealed longitudinal signal pin. The outer shell also includes a relatively high CTE portion that is readily joined as by welding to an adjacent support structure, such as a relatively high CTE aluminum housing and the like.

While I have shown and described several embodiments in accordance with the present invention, it is to be understood that the same is not limited thereto but is susceptible to numerous changes and modifications as known to a person skilled in the art. I therefore do not wish to be limited to the details shown and described herein, but intend to cover all such changes and modifications as are obvious to one of ordinary skill in the art.

What is claimed:

1. A microwave window structure comprising a generally annular metallic frame that has an aperture therethrough, said frame containing a first metallic portion of a first coefficient of thermal expansion (CTE), and a second metallic portion of a second CTE lower than said first CTE, joined with said first metallic portion, a microwave transmission window containing a layer of solder-compatible material around a peripheral portion thereof, and being sized to cover said aperture when placed against said second metallic portion of said generally annular metallic frame, and a layer of solder that joins and hermetically seals said peripheral portion of said microwave transmission window to said second metallic portion of said generally annular frame, in which said first metallic portion has a notch or a groove extending around the annular frame to a depth that approaches the boundary between the first and second metallic portions.

2. The microwave window structure according to claim 1, wherein said second metallic portion of said metallic frame has a depression therein that is sized to engage and seat said peripheral portion of said microwave transmission window.

3. The microwave window structure according to claim 2, wherein said first metallic portion of said generally annular metallic frame has a generally planar surface that is metallurgically bonded to a first, generally planar surface of said second metallic portion of said generally annular frame, and wherein said second metallic portion of said generally annular frame has a second, generally planar surface that is spaced apart from the first, generally planar surface thereof by the thickness of said second metallic portion of said generally annular frame therebetween, and wherein said depression is formed in said second, generally planar surface of said second metallic portion of said annular frame.

* * * * *

UNITED STATES PATENT AND TRADEMARK OFFICE

CERTIFICATE OF CORRECTION

PATENT NO. : 7,365,620 B2
APPLICATION NO. : 11/491811
DATED : April 29, 2008
INVENTOR(S) : Edward Allen Taylor It is certified that error appears in the above-identified patent and that said Letters Patent is hereby corrected as shown below:

| | |
|---|---|
| Column 12, Line 49 | Delete: "(FIG. 14 and in a standard fashion. A metallic bushing 1434" |
| | Insert -- (FIGS. 14 and 15) and in a standard fashion. A metallic bushing 1434 -- |
| Column 12, Line 50 | Delete: "(FIG 15) contains 15) a first material layer 1438 (FIG. 14)" |
| | Insert: -- (FIG 14) contains a first material layer 1438 (FIG. 14) -- |

Signed and Sealed this

Twenty-eighth Day of July, 2009

John Doll

JOHN DOLL
*Acting Director of the United States Patent and Trademark Office*